US007730684B1

(12) United States Patent
Keene

(10) Patent No.: US 7,730,684 B1
(45) Date of Patent: Jun. 8, 2010

(54) WEEP VENTING SYSTEM FOR MASONRY WALLS

(75) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 1161 days.

(21) Appl. No.: 10/623,936

(22) Filed: Jul. 21, 2003

(51) Int. Cl.
*E04B 2/28* (2006.01)
*E04B 1/70* (2006.01)
*E04F 17/00* (2006.01)

(52) U.S. Cl. ..... 52/302.4; 50/302.1; 50/169.5

(58) Field of Classification Search ..... 52/169.5, 52/302.1

See application file for complete search history.

(56) References Cited

U.S. PATENT DOCUMENTS

| | | | | | |
|---|---|---|---|---|---|
| 2,298,319 | A | | 10/1942 | Vatet | 52/232 |
| 2,897,109 | A | | 7/1959 | Voigtman | 428/153 |
| 2,934,931 | A | | 5/1960 | Johnson | 52/302.3 |
| 3,148,101 | A | * | 9/1964 | Allman, Jr. et al. | 156/167 |
| 3,451,758 | A | * | 6/1969 | McClain | 401/201 |
| 3,468,096 | A | * | 9/1969 | Franz | 53/450 |
| 3,500,618 | A | * | 3/1970 | Sokol | 55/484 |
| 3,563,838 | A | * | 2/1971 | Edwards | 428/107 |
| 3,591,395 | A | * | 7/1971 | Zonsveld et al. | 524/8 |
| 3,704,192 | A | * | 11/1972 | Soehngen et al. | 156/167 |
| 4,107,374 | A | * | 8/1978 | Kusunose et al. | 442/400 |
| 4,282,691 | A | | 8/1981 | Risdon | 52/101 |
| 4,304,234 | A | * | 12/1981 | Hartmann | 604/372 |
| 4,315,392 | A | | 2/1982 | Sylvest | 52/309.1 |
| 4,753,834 | A | * | 6/1988 | Braun et al. | 428/74 |
| 5,230,189 | A | | 7/1993 | Sourlis | 52/169.5 |
| 5,343,661 | A | | 9/1994 | Sourlis | 52/169.5 |
| 5,598,673 | A | | 2/1997 | Atkins | 52/302.1 |
| 5,692,348 | A | | 12/1997 | Ambrosino | 52/169.5 |
| 5,768,842 | A | | 6/1998 | Austin | 52/302.3 |
| 5,937,594 | A | | 8/1999 | Sourlis | 52/169.5 |
| 6,023,892 | A | | 2/2000 | Sourlis | 52/169.5 |
| RE36,676 | E | | 5/2000 | Sourlis | 52/169.5 |

(Continued)

OTHER PUBLICATIONS

Mortar Net USA, Ltd, Gary, IN 46403; I-Page Website Printout Entitled "Mortar Net, The Difference Is In TheCut, Weep Vents;" Jul. 17, 2003.

*Primary Examiner*—Robert J Canfield
(74) *Attorney, Agent, or Firm*—Renner, Otto, Boisselle & Sklar, LLP

(57) ABSTRACT

A system for venting moisture from wall and building structures, especially masonry walls constructed from masonry elements such as of brick, block, stone, faux stone or the like, without weakening the wall or building structure, utilizes open matrix weep vent members that are fabricated, for example from a mass of intertwined and intertangled polymeric filaments that are bonded at a plurality of intersections thereby to form one-piece or unit-handled weep vent members that preferably are inserted in place of mortar at spaced locations along horizontally extending mortar joints between rows of bricks, blocks or other masonry wall elements. Weep vent members that embody the present invention have wider portions at their rearward or intake end regions, and narrower portions at their forward or discharge end regions, with a preferred form characterized by a generally trapezoidal shape that helps to retain the weep vent members in their associated mortar joints, and that provide a funnel-like ducting of moisture from their relatively wider rear end regions toward their relatively narrower forward end regions.

13 Claims, 2 Drawing Sheets

U.S. PATENT DOCUMENTS

| | | | | |
|---|---|---|---|---|
| 6,112,476 | A | 9/2000 | Schulenburg | 52/169.5 |
| 6,131,353 | A | 10/2000 | Egan | 52/408 |
| 6,256,955 | B1 | 7/2001 | Lolley et al. | 52/302.3 |
| 6,308,473 | B1 * | 10/2001 | Auck | 52/199 |
| 6,474,031 | B2 | 11/2002 | Phillips | 52/302.1 |
| 6,662,504 | B2 | 12/2003 | Krogstad | 52/61 |
| 6,964,136 | B2 * | 11/2005 | Collins et al. | 52/209 |
| 7,421,826 | B2 * | 9/2008 | Collins et al. | 52/302.1 |
| 7,543,414 | B2 * | 6/2009 | Sourlis | 52/169.5 |
| 2004/0182037 | A1 * | 9/2004 | Sourlis | 52/606 |
| 2005/0066599 | A1 * | 3/2005 | Kimble | 52/302.1 |

* cited by examiner

WEEP VENTING SYSTEM FOR MASONRY WALLS

BACKGROUND OF THE INVENTION

In exterior walls of masonry structures, as houses or commercial buildings, there are a number of locations in the design of the building structure wherein ambient moisture-laden air may become relatively trapped in still air, and in time condense in droplets or drops on adjacent surfaces of masonry, wood or metal which may not be visible to an observer or exposed for treatment. There has been substantial development of devices and arrangements for leading moisture away from relatively trapped areas in masonry and other types of building construction in an effort to overcome this problem. It is well known, for example, to provide drainage tubes through brick walls, to provide porous plugs adjacent the brick that are intended to dissolve in contact with water so that the water may drain, and to insert rigid tubular members in mortar joint areas between adjacent brick.

A proposal also has been made to utilize rectangular blocks of randomly oriented bonded filament material inserted at spaced locations in a brick wall between vertically extending end surfaces of adjacent bricks to form vertical weep vents that are of substantially uniform cross-section as they extend from an interior side of a brick wall to an exterior side thereof. These vertical weep vents have very little width—typically a horizontally measured width that is equal to horizontally measured width of the mortar joints that extend between the vertical end surfaces of adjacent bricks. The uniform width of the vertical weep vents does nothing to "funnel" moisture from interior ends toward exterior ends of the weep vents to facilitate moisture discharge from wall spaces adjacent the interior ends.

BRIEF SUMMARY OF THE INVENTION

The present invention provides a unique weep vent which is easily fabricated, is lightweight, and has relative structural rigidity while permitting free drainage of moisture therethrough and while substantially blocking entry or reverse flow of unwanted particulate materials. To this end, weep vent members are provided for insertion at selected, spaced locations in a masonry wall of a building structure between adjacent masonry elements such as bricks, blocks, stone, faux stone and the like.

The weep vent members preferably take the form of a reach of open matrix material of substantially uniform thickness, each preferably comprising a one-piece or unit-handled mass of intertwined and intertangled filament strands, with each having an inner, rear or interior end region that has a width that is greater than the outer, front or exterior end region thereof. The weep vent members preferably feature a non-uniform cross-section that narrows in width as it extends from the relatively wide inner, rear or interior end regions thereof to the outer, front or exterior end regions thereof, so as to "funnel" moisture from the relatively wide rear end regions toward the relatively narrow front end regions for discharge through the front end regions.

One preferred form features a trapezoidal shape that can be cut efficiently from a sheet or strip of material having a substantially uniform thickness that substantially equals that of the mortar joints areas into which the weep vent members are to be inserted between adjacent elements of masonry walls. The tapered character of the weep vent members not only provides for efficient manufacture but also provides a configuration that resists forward movement of the installed weep vent members; thus, the members are not easily pulled out of masonry walls by vandals, nor do they move forwardly over time so as to project unattractively from the walls in which they have been installed during wall construction. The filaments or strands are preferably polymeric and capable of being heat bonded at their random intersections when the weep vent members are fabricated. Weep vent members, formed as described herein, may be readily positioned in association with a course or courses of brick, block, stone, faux stone or the like without detracting from the structural integrity of the wall.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF PREFERRED EMBODIMENTS

Figure 1:
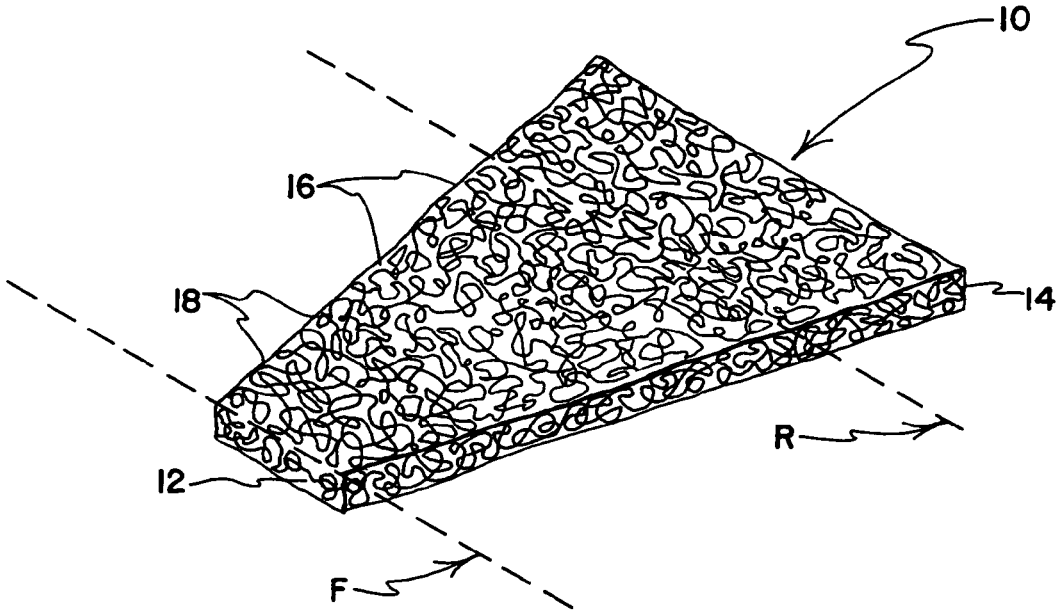
FIG. 1 is a perspective view of a weep vent comprised of an open matrix of intertangled, interconnected fibers embodying one form of the preferred practice of the present invention.

Referring to the drawings, there is shown in FIG. 1 at 10 the subject weep vent in a preferred form for utilization. In the form shown, the weep vent 10 is generally trapezoidal or as a truncated triangle as shown in phantom lines. The weep vent 10 has a narrower forward end region 12, and a wider rearward end region 14. While a trapezoidal shape is preferred due to the efficiency with which weep vent members of this type can be cut from a sheet of bonded filament material, a feature that resides at the heart of the invention is the provision of a weep vent member that has a wider inner, rear or interior end region and a relatively narrower outer, front or exterior end region, and that therefore narrows in cross-section as the member extends from its inner, rear or interior end region toward its outer, front or exterior end region.

The weep vent 10 is formed from an intertangled mass of filaments, strands or strips 16. The many filaments, strands or strips that form the open matrix material of the weep vent 10 have a narrow, string-like appearance as they curl and twist among themselves and as they extend from connected juncture to connected juncture where the filaments, strands or strips 16 abut, with one preferred form being made from extruded filaments having diameters within the range of about 0.025 inch to about 0.030 inch. The same are preferably of polymeric material, as polypropylene, polyethylene, polyolefins, PET, or the like capable of fusing or bonding together under heat or by adhesive at their various points of strand contact or at intersections thereof, as at 18. As such, the resultant product at 10 is lightweight and is quite often open throughout its body thereby to permit ready flow or drainage of moisture therethrough.

In preferred practice, the weep vent 10 is a member that is formed from heated polymer that is extruded to provide a large number of filaments of substantially uniform diameter polymer material that are substantially randomly entangled while still hot just after being extruded so as to form bonds where the curled about filaments engage each other. The bonded and entangled filaments preferably cooperate to define opposed top and bottom sides of the weep vent 10 that extend in substantially parallel planes spaced apart by a distance of preferably about three-eights of an inch to about seven-sixteenths of an inch, which is a typical width commonly found in mortar joints of masonry walls formed from such elements as brick and cinderblock. Further, the weep vent 10 preferably has opposed sides that extend in non-parallel relationship between front and rear end surfaces of unequal length to thereby provide the weep vent 10 with a front surface of the front end 12 that is shorter than a rear surface of the rear end 14—which is another way of saying that the weep vent member 10 has a wider inner, rear or interior end region and a relatively narrower outer, front or exterior end region, and that the cross-section of the weep vent member 10 narrows as the material of the weep vent member 10 extends from the inner, rear or interior end 12 toward the outer, front or exterior end 14.

The non-parallel relationship of the opposed sides, and the rear end region being larger than the front end region assists in retaining the weep vent 10 in a masonry wall so the weep vent 10 will not slip out of its installed location, nor can it readily be extracted by pulling from the front. The funnel shaped character of the weep vent 10 likewise aids in directing moisture from the rear end region 14 toward the narrower front end region 12—a "funneling" function that differs from what is offered in a prior weep vent proposal that also makes use of open matrix, unwoven, randomly oriented fibers, filaments or strands that are bonded at their intersections.

A feature of the weep vent members 10 resides in the width that is offered by their rear end regions—a relatively wide width that performs a moisture collection function that aids in ducting moisture from an interior wall cavity or space for discharge through the weep vent 10. The rear end region 14 preferably has a width that is greater than the vertical thickness of a brick—hence the weep vent members 10 are not intended to be inserted in vertical joints between ends of adjacent bricks in a brick wall. Rather, the weep vent members 10 have a rear end region width that tends to limit the use of the members 10, at least when employed in brick walls, to being positioned in substantially horizontally extending mortar joint areas between rows of bricks.

Figure 3:
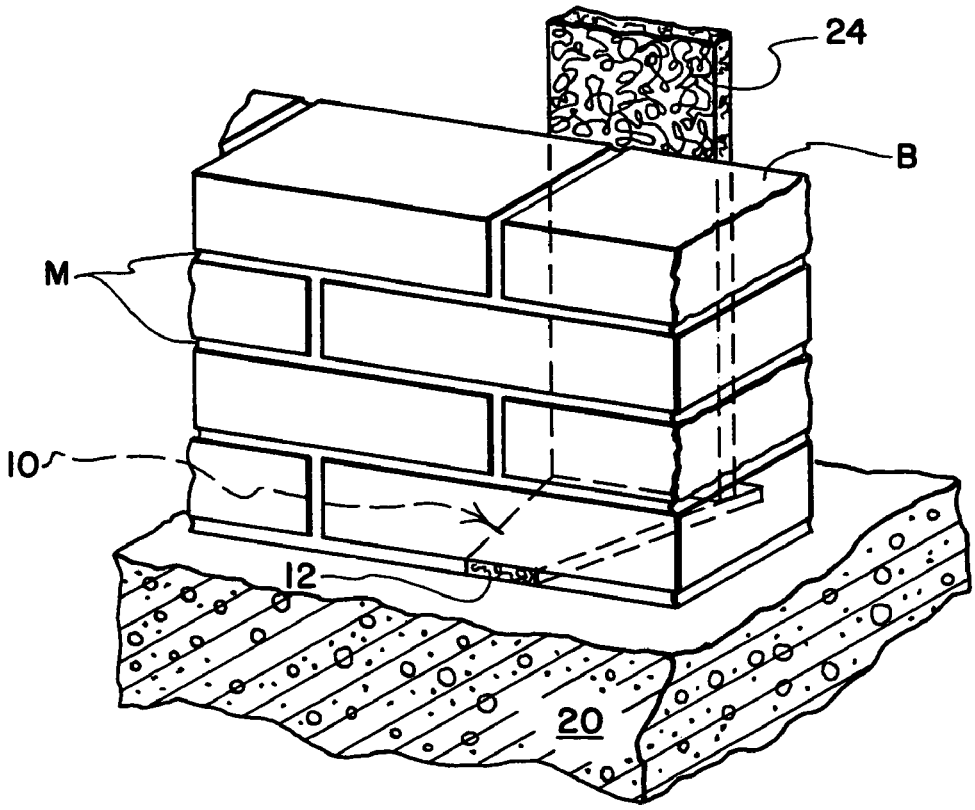
FIG. 3 is a diagrammatic perspective view showing mainly the front of a section of brick wall, with the weep vent of FIG. 1 positioned in a mortar joint area thereof and depicted mainly by broken lines, and with a reach of the open matrix material from which the weep vent is formed extending vertically within a space located just behind the brick wall to lead moisture downwardly to the weep vent; and, FIG. 4 is a diagrammatic perspective view behind the brick wall of FIG. 3 illustrating the positioning of the weep vent of FIG. 1 in a mortar joint area thereof, with the reach of the open matrix material from which the weep vent is formed extending vertically within the space just behind the brick wall.
Figure 4:
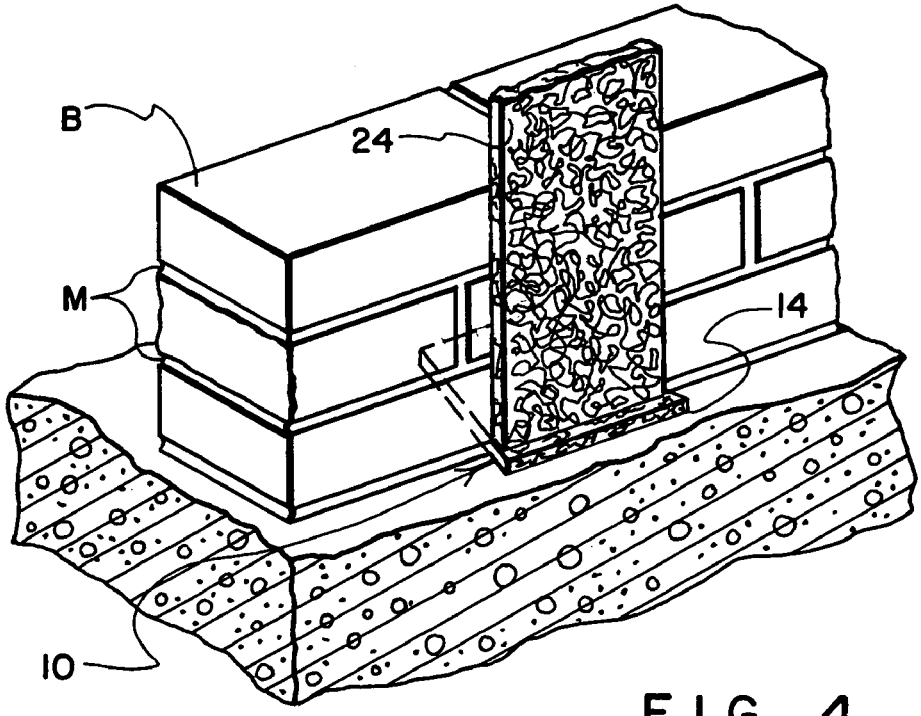

While having an open structure that is relatively rigid and crush resistant, the material from which the weep vent 10 is formed is nonetheless capable of limited flexibility, and is capable of bending or curving through a right angle turn if, for example, an elongated rear end portion of the weep vent needs to be turned upwardly in a space behind a masonry wall to define an open matrix reach that will aid in ducting moisture to the weep vent proper, as is indicated by the numeral 24 in FIGS. 3 and 4. If bending or curving of the weep vent material is not what is desired, the upwardly extending reach of material 24 can be formed from a separate piece of the open matrix material that engages, at its lower end, the rear end region 14 of the weep vent 10 so as to transfer moisture that drains downwardly through the reach 24 into the weep vent 10 for being ducted from the rear end region 14 thereof to the front end region 12 thereof for discharge.

The open matrix weep vent material also has sufficient integrity to be cut into discrete shapes (such as the trapezoidally shaped weep vent members 10 depicted in the drawings) for unit-handling as these members are positioned in discrete selected mortar joint areas of masonry walls to provide a spaced array of weep vents therein, to permit fluid flow therethrough while retarding the inflow through the front end regions 12 thereof of solids or larger particulate material.

The weep vent 10 preferably has a thickness on the order of a typical mortar joint found in a conventional brick wall, and a length somewhat greater than the fore-to-aft width of a conventional brick. The width of the front end 12 of the weep vent 10 normally is substantially less than about one-fourth to one-half of the length of a conventional brick, generally on the order of one-third thereof. However, the front end region 12 may have a width as narrow as one quarter of an inch to one inch, if a weep vent of small size is desired. The rear end region 14 usually has a width of about twice to four times the width of the front end 12.

Figure 2:
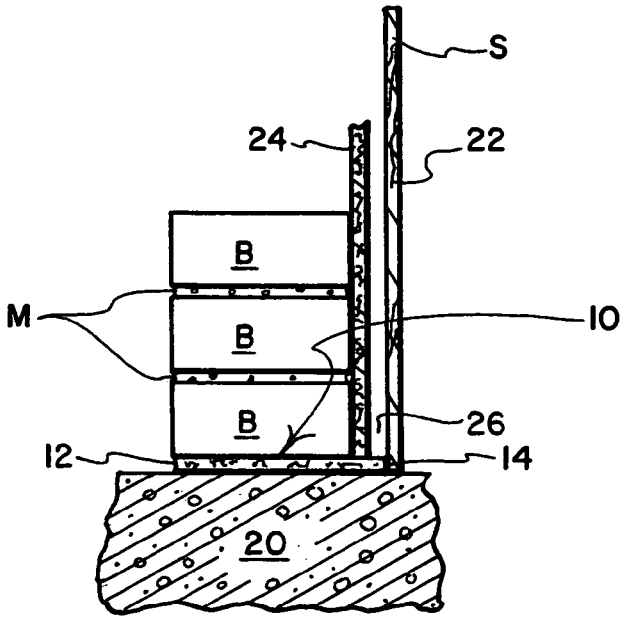
FIG. 2 is a cross-sectional view of a portion of a brick wall on a foundation, with an adjacent panel or wall structure or section spaced therefrom, with the weep vent of FIG. 1 shown positioned to drain moisture from the space therebetween.

The dimensional relationship described just above is suggested by the phantom lines "F" and "R" in FIG. 1, with the line "F" representing the front edge of the brick of a masonry wall, and the letter "R" representing the rear edge of the brick of the masonry wall. It will be seen that the relatively wide rear end region 14 of the weep vent 10 extends past the rear edge "R" of the brick and into the conventional gap or space between the rear face of the brick and a rearwardly spaced second course of brick, vertical sheathing or other usual wall-like structure "S," as seen in FIG. 2.

The cooperative arrangement described above is evident from FIGS. 2 and 3 wherein several courses of brick "B" and interposed mortar "M" are shown, the lower-most course of brick being seated with a layer of mortar on a suitable foundation 20. As seen in FIG. 3, the lowermost mortar layer is suitably gaped to provide a mortar joint area or space that permits the positioning and insertion of weep vent 10 therein, with the weep vent 10 having its opposed sides in engagement with mortar laid in the mortar joint, with the top and bottom surfaces of the weep vent in engagement with a brick (or other associated element of the masonry wall) that overlies the weep vent 10, and with a foundation surface that underlies the weep vent 10. While the weep vent 10 is shown installed directly atop a foundation, the weep vents 10 also may be placed higher in masonry walls, in mortar joint areas between courses of masonry elements such as bricks, blocks, stones, faux stones or the like, so as to have their top and bottom surfaces in engagement with overlying and underlying courses of masonry elements.

The narrow forward end region 12 of the weep vent 10 is at the exterior or front surface of the wall, while the rear end 14 thereof extends rearwardly past the width of the brick and into the gap 26 between the brick wall and the interiorly positioned wall structure 22, which may be formed of sheathing, further brick, or other conventional construction arrangements. The lightweight polymeric nature of weep vent 10 readily permits the material from which the weep vent is formed to be shaped in width and length as desired for any particular wall environment, as by cutting away any unwanted portions thereof. The forward end 12 of the weep vent 10, while substantially narrower than the rear end 14 thereof, is nonetheless effectively wider than the usual cylindrical materials hitherto provided for wall drainage purposes, and can thus effect discharge of moisture more reliably, with less clogging at a higher rate and volume.

Referring to FIGS. 3 and 4, when the weep vents 10 are provided in masonry walls in the manner described above, moisture or drip condensate gathering or occurring on the rear face of the masonry walls or along the rear sides of mortar joints thereof will flow downwardly under the influence of gravity through in the gap or space 26 located behind the walls. On encountering the rear portion of the weep vent 10 which extends past the rear edge of the brick or other masonry elements that comprise the wall, the moisture is ducted through the wall by the weep vent 10 for discharge to the exterior. In this manner it will be seen that water will be unable to accumulate in the gap between the brick and the rear wall 22, as any depth thereof will encounter the weep vent and drain from its rear end 14 to the outside 12.

In this regard, while the space behind the wall is relatively confined, it is generally known to provide at least minimal ventilation thereinto at the top of a wall as behind a soffit, for example, but which has no direct exposure to the exterior of the building thereby to preclude rain entry thereinto, for example.

The foregoing is descriptive of the weep vent 10 as employed with brick. The same is also usable with masonry walls formed using other masonry elements such as cinderblock, stone or faux stone, for example. The same parameters apply, with the weep vent 10 having a thickness comparable to joint mortar thickness, and having a length sufficient to extend behind the cinderblock or other associated masonry element for venting the internal space 26 in the same manner.

In order to facilitate the ducting of condensation or drip moisture from an interior wall space down to the area of one of the weep vents 10, an additional reach 24 of the open matrix material (of the type from which the weep vent 10 is cut) may be positioned in the interior wall space located behind the brick of a masonry wall, seated at its lower end upon the rear end region 14 of the weep vent 10. The upwardly extending reach of material 24 may be mechanically fastened to an interior surface of the wall or may be tacked thereonto with adhesive or otherwise held in place by conventional fasteners (not shown). In so providing the vertically extending reach of material 24, the intertwined strands thereof define a substantial surface area for the collection of moisture to eventually gravitate downwardly onto the associated weep vent 10 for discharge therethrough and outwardly of the wall. Further, the reach of material 24 may be integral with the weep vent 10 (as mentioned previously) to aid the discharge of moisture through the weep vent 10 and outwardly of the wall.

While in the preferred embodiment, the weep vent 10 is trapezoidal as shown, the same may partake of other forms wherein the rear portion is wider than the forward moisture discharging or front end region 12, as may be desired in any particular construction environment. Typically, a usual brick is about three and a half inches in width, while the gap or cavity behind the brick or masonry may be on the order of one inch or so. A one-inch gap 26 is a preferred minimum in most masonry wall construction. Accordingly, the length of the weep vent 10 from fore to aft would be on the order of 4.25 inches, with the width of the front end 12 being about one inch, with the width of the rear end region being on the order of about three inches. As indicated, the thickness of the weep vent 10 approximates the usual mortar thickness between brick of about three eighths of an inch. These are figures for conventional brick.

Brick and cinderblock, and other masonry materials from which masonry walls are constructed such as stone or faux stone and the like, are available in many sizes, sometimes up to eighteen inches or more in length with varying widths. The dimensions of the weep vent would be adjusted accordingly and might be as high as two and a half inches for the width for the front drain end region 12, or even wider so long as the width of the front end region 12 is substantially less than the length of an associated masonry element that overlies the weep vent 10, with the rear end region 14 preferably being wider than the front end region 12 so that the weep vent 10 so the weep vent 10 cannot be easily discharged from or pulled out from the mortar joint area where it is installed. In practical terms, the minimum width for the front 12 would be about one quarter of an inch.

The weep vent of the invention can be placed at plural points along a wall to an effective extent of about ten percent of the mortar joint area beneath a given course of brick while still having sufficient strength to support the brick and not detract from the strength of the wall.

While polymeric filaments are preferred for the intertangled mass forming the weep vent as the same are readily available and processable in known manner, as illustratively shown by Voigtman U.S. Pat. No. 2,897,109 or Sylvest U.S. Pat. No. 4,315,392, the disclosures of which are incorporated herein by reference. The material from which weep vents embodying the invention are formed may agree with what is depicted in FIG. 14 of Sourlis U.S. Pat. Nos. 5,230,189, 5,343,661 and Re-36,676, and may be consistent with what is disclosed in these patents about such material, the disclosures of which patents are incorporated herein by reference. It is within the scope of the invention to employ other materials now known and hereafter existing that are capable of fulfilling the requisite structure and function, to provide an open matrix of material that will perform as described.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

The invention claimed is:

1. A weep vent for masonry wall structures comprising a shaped mass of intertwined filaments having substantial open areas, the weep vent being positionable in a mortar joint of the wall structure for venting moisture from one side of the masonry wall structure to the other, wherein the weep vent includes a narrower front end and a wider rear end, wherein when the weep vent is positioned within a masonry wall structure, the narrower front end is on an exterior side of the masonry wall structure and the wider end is disposed on an interior side of the masonry wall structure for the purpose of receiving and funneling moisture from the interior side of the masonry wall structure through the weep vent from the interior side of the masonry wall structure to the exterior side of the masonry wall structure, wherein the intertwined filaments of the shaped mass are randomly connected at their intersections to form a unit-handled structure, which unit-handled structure is substantially planar and has a substantially uniform thickness that substantially equals that of a mortar joint area of a masonry wall wherein the weep vent is to be installed, and wherein the weep vent member additionally comprises opposed sides that extend in non-parallel relationship between the front end and the rear end; and wherein the weep vent additionally includes a reach of substantially the same material from which the weep vent is formed, and that when the weep vent is positioned in the masonry wall structure, the reach extends upwardly from the wider rear end region of the weep vent in a wall space located above the wider rear end region of the weep vent.

2. The weep vent of claim 1 wherein the filaments of the shaped mass are polymeric.

3. The weep vent of claim 1 wherein the filaments have a diameter of between about 0.025 inch and about 0.030 inch.

4. The weep vent of claim 1 wherein the unit-handled structure is substantially trapezoidal in form.

5. The weep vent of claim 1 wherein the unit-handled structure is dimensioned to have a length, as measured from the front end to the rear end, that is greater than the width of an associated masonry member as measured from an exterior face thereof to an interior face thereof, wherein the wider rear end of the unit-handled structure thereof extends beyond the interior face of the associated masonry member to better receive moisture from a space adjacent the interior face of the associated masonry member.

6. The weep vent of claim 1 wherein the extruded filaments are of substantially uniform diameter.

7. The weep vent of claim 1 wherein the opposed sides each are substantially flat, wherein the front and rear end surfaces are substantially flat and extend in substantially parallel planes, and wherein the configuration of the weep vent as cooperatively defined by the opposed sides and the front and rear end surfaces is substantially trapezoidal.

8. A weep vent cooperatively associated with a masonry wall comprising a substantially planar member formed from interconnected and intertangled filaments having substantial open areas between and around the filaments to permit moisture to pass therethrough and forming a unit-handled structure for ready placement in a mortar joint area of the masonry wall under construction, wherein the weep vent has an inner end region and an outer end region for being installed proximate inner and outer surfaces, respectively, of the masonry wall, with the inner end region being wider than the outer end region, and with the weep vent member additionally having opposed sides that extend in non-parallel relationship between the inner end region and the outer end region, and wherein the weep vent additionally includes a reach of substantially the same material from which the weep vent is formed that extends upwardly from the wider rear end region of the weep vent in a wall space disposed above the wider end region of the weep vent.

9. A weep vent for masonry wall structures comprising a shaped mass of intertwined filaments having substantial open areas, the weep vent being positionable in a mortar joint of the wall structure for venting moisture from one side of the masonry wall structure to the other, wherein the weep vent includes a narrower front end and a wider rear end, wherein when the weep vent is positioned within a masonry wall structure, the narrower front end is on an exterior side of the masonry wall structure and the wider end is disposed on an interior side of the masonry wall structure for the purpose of receiving and funneling moisture from the interior side of the masonry wall structure through the weep vent from the interior side of the masonry wall structure to the exterior side of the masonry wall structure, wherein the intertwined filaments of the shaped mass are randomly connected at their intersections to form a unit-handled structure, which unit-handled structure is substantially planar and has a substantially uniform thickness that substantially equals that of a mortar joint area of a masonry wall wherein the weep vent is to be installed, and wherein the weep vent member additionally comprises opposed sides that extend in non-parallel relationship between the front end and the rear end;

wherein the unit-handled structure has a thickness on the order of the thickness of a typical mortar joint of the masonry wall structure with which the weep vent is associated;

wherein the unit-handled structure is dimensioned to have a length, as measured from the front end to the rear end, that is greater than the width of an associated masonry member as measured from an exterior face thereof to an interior face thereof, wherein the wider rear end of the unit-handled structure thereof extends beyond the interior face of the associated masonry member to better receive moisture from a space adjacent the interior face of the associated masonry member; and wherein the wider rear end includes a vertically extending reach of substantially the same intertwined filament material from which the weep vent is formed, with the vertically extending reach extending upwardly from the weep vent into said space.

10. A weep vent cooperatively associated with a masonry wall comprising a substantially planar member formed from interconnected and intertangled filaments having substantial open areas between and around the filaments to permit moisture to pass therethrough and forming a unit-handled structure for ready placement in a mortar joint area of the masonry wall under construction, wherein the weep vent has an inner end region and an outer end region for being installed proximate inner and outer surfaces, respectively, of the masonry wall, with the inner end region being wider than the outer end region, and with the weep vent member additionally having opposed sides that extend in non-parallel relationship between the inner end region and the outer end region; and wherein the masonry wall includes block and foundation elements secured in conventional manner by mortar joints between the elements, and wherein the weep vent is interposed in a mortar joint area adjacent an associated block element that overlies the weep vent, with the inner end region proximate an inner surface of the associated block element, and the outer end region proximate an outer surface of the associated block element for permitting moisture to pass through the weep vent from proximate the inner surface toward the outer surface.

11. A weep vent cooperatively associated with a masonry wall comprising a substantially planar member formed from interconnected and intertangled filaments having substantial open areas between and around the filaments to permit moisture to pass therethrough and forming a unit-handled structure for ready placement in a mortar joint area of the masonry wall under construction, wherein the weep vent has an inner end region and an outer end region for being installed proximate inner and outer surfaces, respectively, of the masonry wall, with the inner end region being wider than the outer end region, and with the weep vent member additionally having opposed sides that extend in non-parallel relationship between the inner end region and the outer end region; and wherein the front end region is substantially flush with the outer surface, and the rear end region projects rearwardly from the inner surface.

12. The weep vent of claim 11 additionally including a reach of substantially the same material from which the weep vent is formed that extends upwardly from the wider rear end region of the weep vent in a wall space located above the wider rear end region of the weep vent.

13. A weep vent cooperatively associated with a masonry wall comprising a weep vent member formed from extruded filaments of heated polymer material that are entangled while still hot after being extruded so as to form bonds between the filaments where the filaments engage each other, with the bonded and entangled filaments cooperating to define opposed sides of the weep vent member that extend in substantially parallel planes, and with the weep vent member additionally having opposed sides that extend in non-parallel relationship between front and rear end surfaces of unequal length to provide the weep vent member with a generally planar configuration characterized by a front end surface that is shorter in length than the rear end surface; and a reach of substantially the same extruded entangled filament material from which the weep vent is formed, with the reach of material being adapted to extend upwardly from the rear end region of the weep vent when the weep vent is installed in a mortar joint area of a masonry wall to aid in ducting moisture from within an interior space of the masonry wall to the rear end region of the weep vent for passage through the weep vent and discharge through the front end region of the weep vent.

* * * * *